US007731129B2

(12) United States Patent
Stull et al.

(10) Patent No.: US 7,731,129 B2
(45) Date of Patent: Jun. 8, 2010

(54) METHODS AND SYSTEMS FOR VARIABLE RATE COMMUNICATION TIMEOUT

(75) Inventors: Craig Alan Stull, Kansas City, MO (US); Stephen Harold Humphrey, Pleasant Hill, MO (US); John Zimmerman, Lee's Summit, MO (US); Warren Burnett, Lee's Summit, MO (US)

(73) Assignee: General Electric Company, Schenectady, NY (US)

( * ) Notice: Subject to any disclaimer, the term of this patent is extended or adjusted under 35 U.S.C. 154(b) by 449 days.

(21) Appl. No.: 11/821,665

(22) Filed: Jun. 25, 2007

(65) Prior Publication Data

US 2008/0315044 A1 Dec. 25, 2008

(51) Int. Cl.
*B61L 3/00* (2006.01)

(52) U.S. Cl. ..... 246/3; 246/167 R; 246/4; 246/5; 246/6; 701/19

(58) Field of Classification Search ..... 246/3, 246/4, 5, 6, 15, 47, 55, 59, 62, 220, 117, 246/166.1, 166, 164, 167 R, 182 R, 182 B, 246/182 C, 186, 187 R, 187 A, 187 B; 340/5.28; 701/19, 20

See application file for complete search history.

(56) References Cited

U.S. PATENT DOCUMENTS

| | | | | |
|---|---|---|---|---|
| 4,532,509 | A * | 7/1985 | Pulverenti et al. | 340/825 |
| 4,711,418 | A | 12/1987 | Aver, Jr. et al. | |
| 5,340,062 | A | 8/1994 | Heggestad | |
| 5,533,695 | A | 7/1996 | Heggestad et al. | |
| 6,459,965 | B1 | 10/2002 | Polivka et al. | |
| 7,222,003 | B2 | 5/2007 | Stull et al. | |
| 2004/0049327 | A1 | 3/2004 | Kondratenko et al. | |

* cited by examiner

*Primary Examiner*—Mark T Le
(74) *Attorney, Agent, or Firm*—John A. Kramer, Esq.; Armstrong Teasdale LLP

(57) ABSTRACT

Methods and systems for communicating with a vehicle are provided. The method includes providing a plurality of wayside control units controlling an area along a guideway to be traveled by the vehicle, the plurality of wayside control units including a database of fixed data defining an operational profile of the guideway in a local area of an associated wayside control unit. The method also includes monitoring dynamic data in the local area of the associated wayside control unit wherein the dynamic data includes at least one of guideway availability and signal status information and transmitting wirelessly an authority message including at least one of the fixed data and the dynamic data from the associated wayside unit to a receiver on board the vehicle, the authority message dynamic data being valid for a selectable one of a plurality of time periods.

22 Claims, 5 Drawing Sheets

METHODS AND SYSTEMS FOR VARIABLE RATE COMMUNICATION TIMEOUT

BACKGROUND

This invention relates generally to controlling the movement of a vehicle along a guideway, and more specifically to methods and systems for utilizing variable rate communication timeouts in vehicle control systems.

At least some known rail traffic signal systems use an extensive array of wayside equipment to control railway traffic and maintain safe train separation. In these known systems, railway control is achieved by detecting the presence of a train, determining a route availability for each train, conveying the route availability to a train's crew, and controlling the movement of the train in accordance with the route availability.

The presence of a train is typically detected directly through a sensor device, or track circuit, associated with a specific section of the rails, referred to as a block. For example, the presence of a train may cause a short in a block's track circuit. In this manner, the occupancy of each block is determined. Vital decision logic is employed, utilizing the block occupancy information in conjunction with other information provided, such as but not limited to track switch positions, to determine a clear route availability for trains. The route availability information is then conveyed to a train crew through a communication-based train control (CBTC) system using a wireless transmission circuit, such as a radio or cellular telephone. The CBTC system generally includes a computer at one or more fixed locations determining the movement authority and/or constraints applicable to each specific train. The computer then transmits this train-specific information in unique messages addressed or directed to each individual train. In some known systems such as an incremental train control system (ITCS), an authority message is broadcast to any train that may be within receiving distance. The train movement is then controlled by crew actions based on displayed aspect information and, in case of failure by the crew to take necessary actions, through optional speed enforcement.

In the current ITCS approach, all authority and occupancy reporting vital train to wayside and wayside to train communications have a preset timeout value. If data is not received within this time, safety critical actions are taken, generally in the form of a penalty brake. However, in portions of the track system, the timeout value is overly strict and has a negative impact on system performance.

SUMMARY

In one embodiment, a method of communicating with a vehicle includes providing a plurality of wayside control units controlling an area along a guideway to be traveled by the vehicle, the plurality of wayside control units including a database of fixed data defining an operational profile of the guideway in a local area of an associated wayside control unit. The method also includes monitoring dynamic data in the local area of the associated wayside control unit wherein the dynamic data includes at least one of guideway availability and signal status information and transmitting wirelessly an authority message including at least one of the fixed data and the dynamic data from the associated wayside unit to a receiver on board the vehicle, the authority message dynamic data being valid for a selectable one of a plurality of time periods.

In yet another embodiment, a system for controlling the movement of a train along a railroad track includes a data base configured to store fixed data defining an operational profile of one or more local areas associated with the track and a plurality of wayside control units configured to control an area along the track, each wayside control unit configured to monitor track availability and signal status information in a corresponding local area of the wayside control unit. The system also includes a communication link configured to transmit the fixed data for the area and dynamic data including track availability and signal status information to a train within the associated local area wherein the dynamic data is valid for at least one of a time period selectable from a plurality of time periods and a determined period of time.

In another embodiment, a method of controlling the movement of a train along a block of railroad track includes transmitting wirelessly an authority message including at least one of fixed data and dynamic data from a wayside unit associated with the block of railroad track to a receiver on board the train wherein the authority message dynamic data is valid for a period of time determined using at least one of the fixed data, the dynamic data, the braking characteristics of the train, a speed of the train, a location of the train, and a proximity of the train to a home signal.

DETAILED DESCRIPTION

The following detailed description illustrates the disclosure by way of example and not by way of limitation. The description clearly enables one skilled in the art to make and use the disclosure, describes several embodiments, adaptations, variations, alternatives, and uses of the disclosure, including what is presently believed to be the best mode of carrying out the disclosure. The disclosure is described as applied to a preferred embodiment, namely, a process of communicating with a train locomotive along a railroad track. However, it is contemplated that this disclosure has general application to communicating with vehicles along any guideway where adherence to a specified authority is desired, particularly where two or more vehicles have the capability of encroaching on each other's position if the authority is not adhered to.

Figure 1:
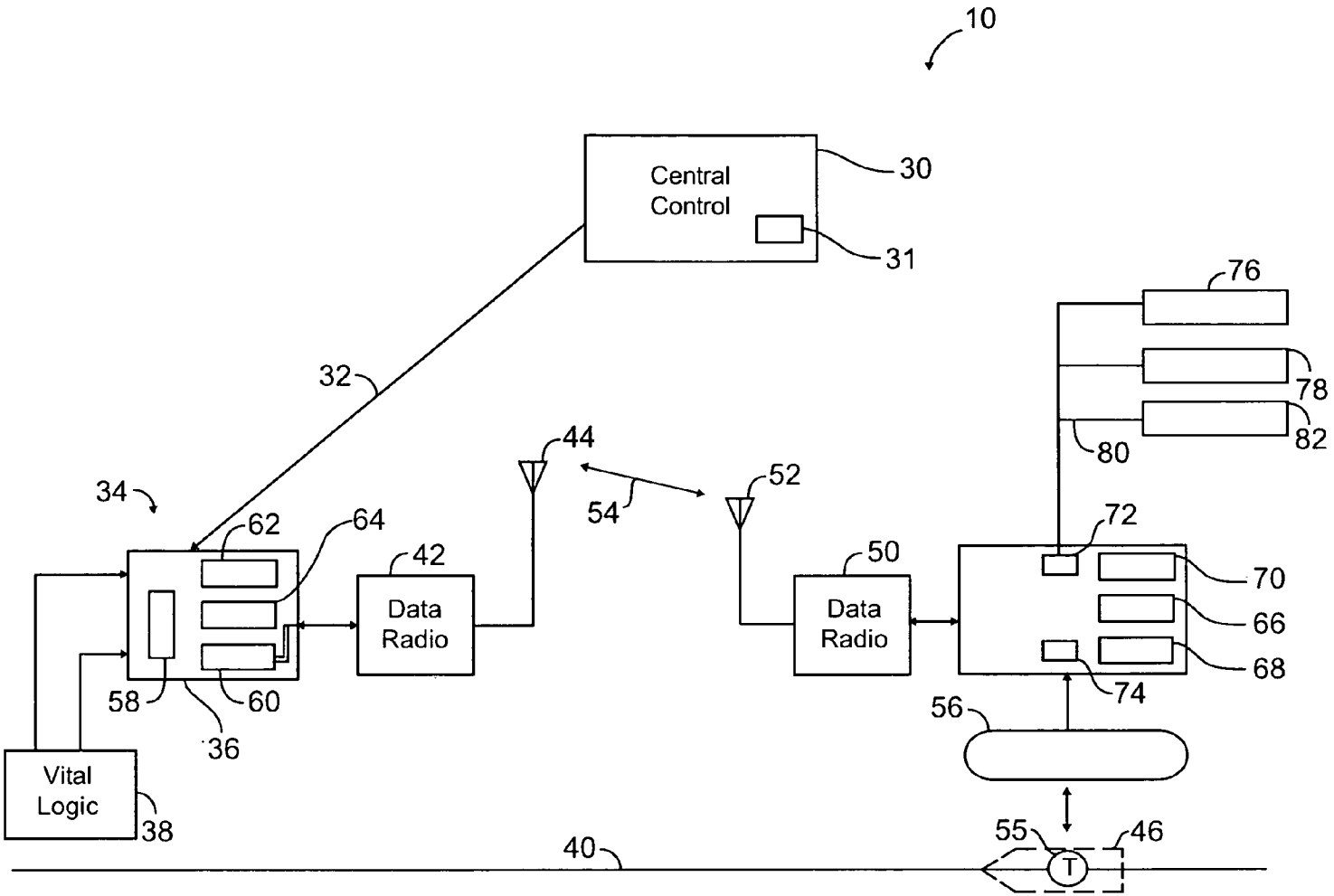
FIG. 1 is a block diagram of a system for controlling the movement of a plurality of vehicles on a guideway in accordance with an embodiment of the present invention.

FIG. 1 is a block diagram of a system 10 for controlling the movement of a plurality of vehicles on a guideway (not shown in FIG. 1) in accordance with an embodiment of the present invention. In the exemplary embodiment, a central control office facility 30 includes master fixed data files stored in a central computer memory 31 and which contain data relating to the profile of a route under control. The fixed data typically remains unchanged for the route for relatively long periods of time. The fixed data files may include such information as the location of guideway under repair and an appropriate temporary slow order, the location of critical locations and any other points at which a control action may be necessary, timetable speed limits, and civil speed restrictions. A dispatcher data line 32 such as a wired or wireless transmission path, connects the central control 30 with a wayside control unit 34 which includes a wayside interface unit (WIU) 36, vital logic 38 associated with a particular location on a guideway 40, and a data radio 42 having an antenna 44. A plurality of wayside control units 34 are controlling an area along guideway 40 under control at interlockings and special detection sites and are in communication with central control 30 via their respective dispatcher data lines 32. Accordingly, relevant portions of the master fixed data files are downloaded from central control 30 to the wayside control units 34 via respective data lines 32 so that each wayside control unit 34 has the profile of the particular local area of the route under its control.

Although FIG. 1 is described with reference to central control 30, in other embodiments central control 30 is not used. Central control 30 via the dispatcher data lines 32 provides a means of instantly updating the route profile as may be necessary from time to time. However, the local fixed data files of the individual wayside control units 34 may be individually maintained and updated as changes in fixed data occur in affected local areas.

The vital logic 38 typically includes existing track circuits and signal circuits associated with a wayside signal. Therefore, WIU 36 utilizes this signal and track status information to provide the dynamic data that includes an authority message transmitted by data radio 42. WIU 36 includes a status monitor 58 that receives the information from the track circuits (presence or absence of a train) and signal circuits (aspects) of the vital logic 38 and delivers this information to a data manager and interface 60. A communications interface 62 receives the fixed data updates when they appear on the dispatcher data line 32 and delivers the updates to a memory 64 containing the local profile database. Data manager 60 employs a microprocessor to handle fixed data from memory 64 and dynamic data from monitor 58 to form the profile and authority messages delivered to data radio 42 for transmission via antenna 44.

A vehicle 46, for example, but not limited to a train includes a speed monitoring and enforcement computer (OBC) 48 that receives profile and authority messages from wayside control unit 34 via a data radio 50 having an antenna 52. A radio link 54 is used to transmit communications between data radio 42 of wayside control unit 34 and on-board data radio 50. A trackside transponder 55 on guideway 40 is a passive beacon transponder that is interrogated by vehicle 46 through an interrogator antenna 56, which is typically mounted adjacent the underside of vehicle 46. When interrogated, transponder 55 responds with a data message including, for example, a location reference such as a milepost number. On-board computer 48 merges such train location information with the fixed and dynamic data received via radio link 54 to determine the proper train control instructions. In other embodiments equipment other than beacon transponders are used for location reference. In other embodiments, train location is determined onboard the train using for example, but not limited to GPS, radio ranging, machine readable mile markers such as RFID-enabled mile markers.

During operation, data radio 50 when in a receive mode decodes incoming profile and authority messages and delivers that data to speed monitoring and enforcement computer (OBC) 48. The hardware components of OBC 48 include a central processing unit (CPU) 66, a read-only memory 68 for program storage, a random access memory 70 for storage of transient data derived from the input dynamic and fixed data, and interfaces 72 to the inputs and outputs of OBC 48.

A transponder interrogator 74 connected to antenna 56 interrogates trackside transponders such as transponder 55, the location data read by the interrogator 66 is transmitted to the OBC 48 where it is integrated with fixed and dynamic data from data radio 50 so that OBC 48 may determine the proper train control instructions. Other inputs to OBC 48 include a speed sensor input 76 from a speed sensor such as an axle tachometer, a reverser lever position input 78 for direction of movement of the vehicle. An operator display and control unit 72 located in vehicle 46 displays various information to the vehicle crew. Such information may include but is not limited to current vehicle speed, the speed limit currently in effect based on the authority information received, the current milepost, the direction of movement, a target speed in response to an upcoming speed restriction, the target type, for example, but not limited to Home Signal, Intermediate Signal, or Temporary Speed Order, a distance to target, and a time to penalty, which informs the crew of the time remaining before a penalty brake will be applied if the train continues at its present speed. The penalty brake command is delivered by removing a vital output 80 of OBC 48 to a brake interface 82. Operator display and control unit 72 also displays the current speed limit to the operator and the active target. Displaying this information in this manner makes the block status visible to the train crew continuously, not just while approaching a wayside signal, and also permits any change in block status to be displayed immediately as it happens rather than at the next wayside signal which may be far ahead and out of sight at the time of the change in status.

Figure 2:
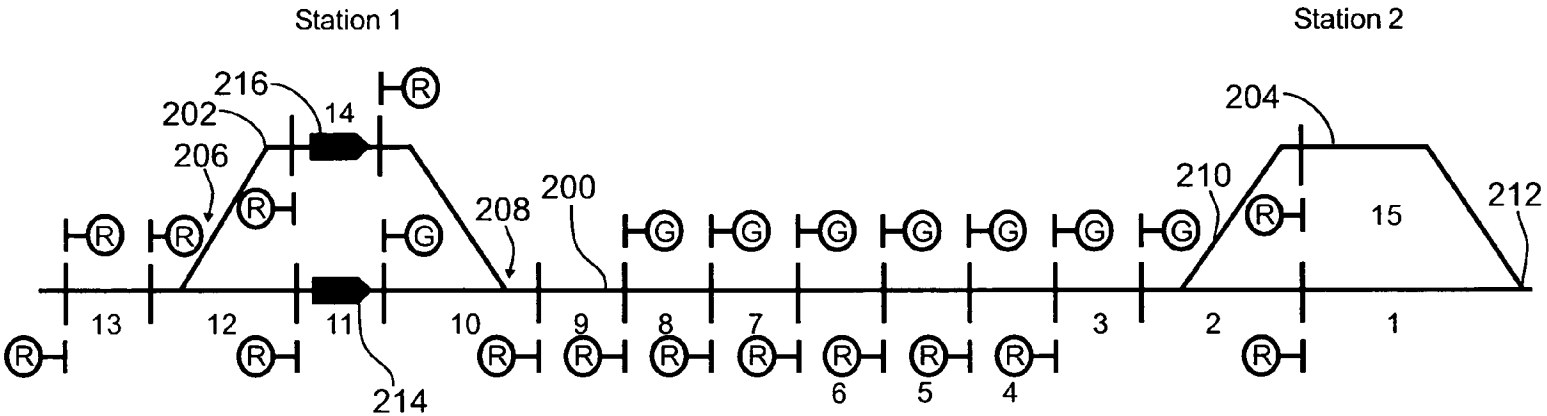
FIG. 2 is a layout diagram of a guideway including a single track and two passing sidings that may be used with the system described in FIG. 1.

FIG. 2 is a layout diagram of a guideway including a single track 200 and two passing sidings 202 and 204. Interlockings 206 and 208 join siding 202 to track 200 at switches (not shown) under the control of a separate vehicle management system. Similarly, interlockings 210 and 212 join siding 204 to track 200 at switches (also not shown).

Wayside control units 34 (shown in FIG. 1) control sections of track that may include one or more blocks along track 200 numbered in FIG. 2, from block 1 to block 15. Each unit (WCU) 34 is responsible for the control of trains approaching it within a respective local area covered by WCU 34. At any one time, a vehicle may be within the local area of more than one WCU 34, and receiving authorities from each of them.

During operation, as a vehicle, such as a first vehicle 214 approaches a block, on-board computer (OBC) 48 commands the data radio 50 (shown in FIG. 1) to establish a connection to receive a movement authority from the respective WCU 34. OBC is aware of the approaching block because OBC 48 on vehicle 214 is continuously provided with the location of vehicle 214 along track 200. The OBC 48 has in memory the profile of the local area.

Dynamic data, which is a portion of the authority message requested by OBC 48, is subject to change. An authority message is typically considered valid for only a predetermined time period such as fifteen seconds. If not periodically refreshed, OBC 48 executes a default rule for the particular local area as contained in the profile message in memory. If a repeat transmission of the authority message is not received after transmitting a predetermined number of successive update requests, the default rule is applied.

Some areas where a vehicle is likely to operate may be susceptible to short train to wayside and wayside to train communication anomalies. Such anomalies may cause a timeout to be exceeded which could cause the default rule to be applied unnecessarily. In the exemplary embodiment, the timeout period is variable depending on the vehicle location. For example, the allowed timeout delay when approaching a home signal is set relatively shorter than when the vehicle is in between a large block between intermediate signals. The timeout values are selected from a database or determined dynamically to decrease or increase as necessary as the vehicle approaches or exits local areas having different needs for current dynamic data.

In the exemplary embodiment, OBC includes predetermined timeout values for each block. As the vehicle passes each block, the Status Update (Movement Authority Message) Timeout value is rest to the predetermined value. If a timeout occurs, OBC 48 assumes all wayside signals are in their most restrictive state. If the vehicle is near or on approach blocks, the timeout value is maintained as currently specified, if the vehicle is in blocks in which intermediate signals exist, the timeout value may be increased to a longer value. In addition, each train transmits a location message to all WCU 34 if at least one WCU 34 does not receive a location transmission from a train within a predetermined time period or a determined period of time, WCU 34 executes predetermined corrective action instructions such as places signals in a most restrictive mode.

Wayside control units 34, compiles information from interlockings and vehicles in its control area and sends movement authorities and other information to individual vehicles. In the exemplary embodiment, WCU 34 includes predetermined timeout values for all blocks. Additionally, WCU 34 is configured to dynamically determine timeout values depending on guideway and vehicle conditions and data transmitted to it from central control 30. When a train is far from the approach block, a longer time out can be allowed before a Block Communication Failure (BCF) is set. As used herein, Block Communication Failure indicates that the position of the train along the route is unknown to the WCU from its last known position to the next home signal. The timeout is determined to be shorter as the vehicle nears the approach block to ensure that a BCF is set if the train times out in the approach block.

Vehicle 214 has a route lined from Station 1 to Station 2 as indicated by green signals between vehicle 214 and interlocking 210. A second vehicle 216 is waiting in the siding at Station 1 to do a following move. Blocks 11 and 14 are indicated as being "occupied." Prior to vehicle 214 departure, vehicle 214 will request and must receive a BOM Acknowledge before being allowed to upgrade past the signal. As used herein, a Block Occupancy Message acknowledge describes a message procedure wherein the train receives an acknowledgment from WCU 34 that the WCU 34 has received the train location message. The acknowledgment ensures the train does not enter a block unprotected by the WCU 34 because the WCU 34 did not receive the location message.

Figure 3:
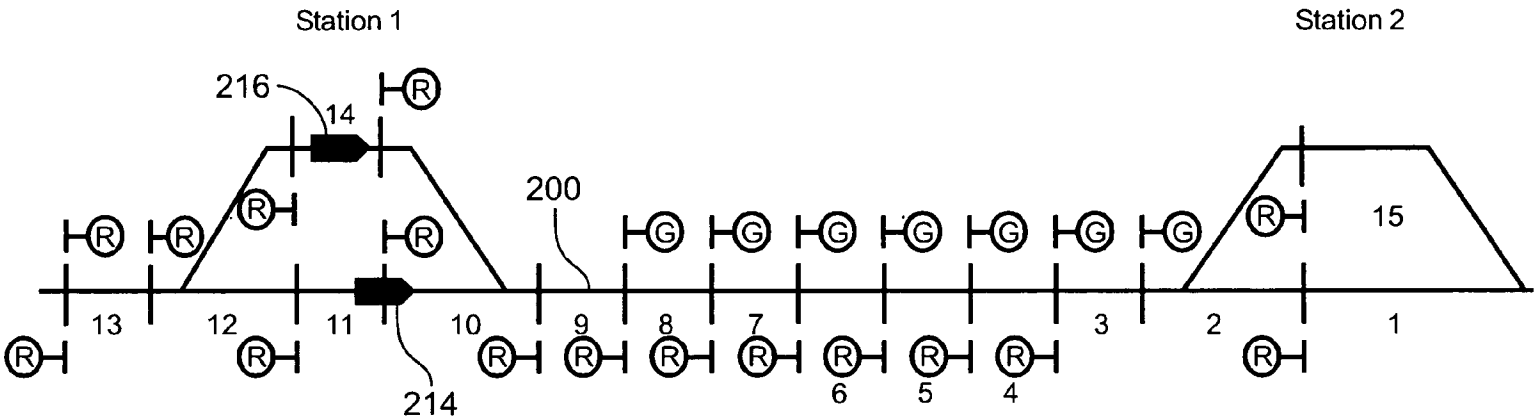
FIG. 3 is the layout of the guideway shown in FIG. 2 with first and second vehicles advancing along the guideway.

FIG. 3 is the layout of guideway 200 (shown in FIG. 2) with vehicles 214 and 216 advancing along guideway 200. Vehicle 214 moves forward on the route toward station 2. Block number 10 changes to indicate "occupied" as the front of vehicle 214 moves onto Block number 10. Vehicle 216 is still not permitted to advance.

Figure 4:
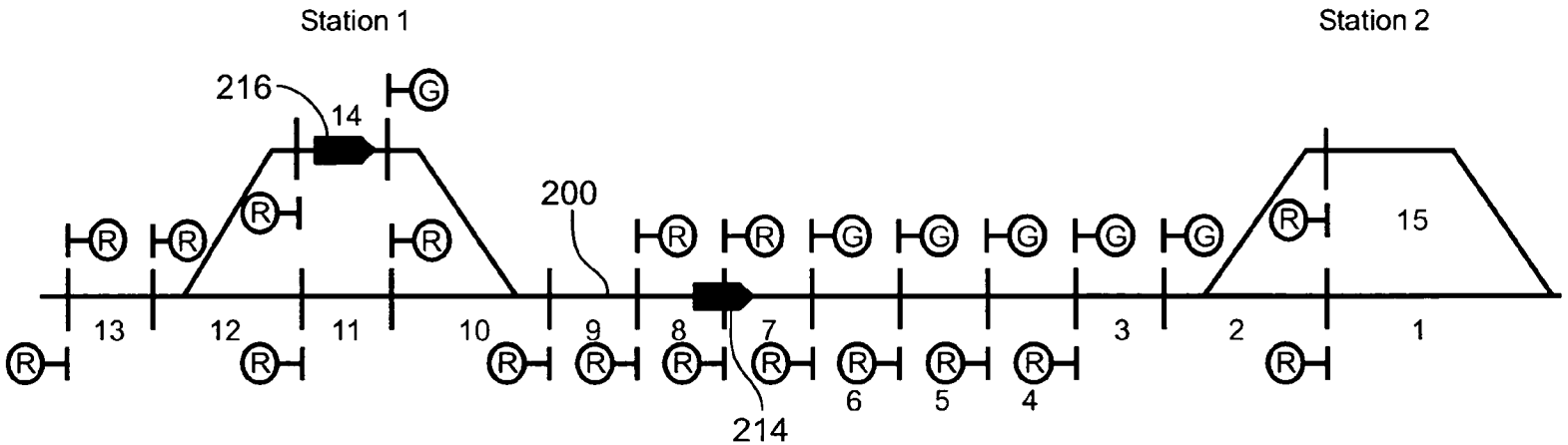
FIG. 4 is a layout diagram of the guideway shown in FIG. 2 with the first and second vehicles further advancing along the guideway.

FIG. 4 is a layout diagram of guideway 200 (shown in FIG. 2) with vehicles 214 and 216 further advancing along guideway 200. Vehicle 214 continues to move forward on the route to station 2 and is illustrated occupying Block numbers 8 and 7. A centralized traffic control (CTC) system indicates the guideway in front of vehicle 216 is available for vehicle 216 to advance by clearing the departure signal for vehicle 216 to start a following move.

Figure 5:
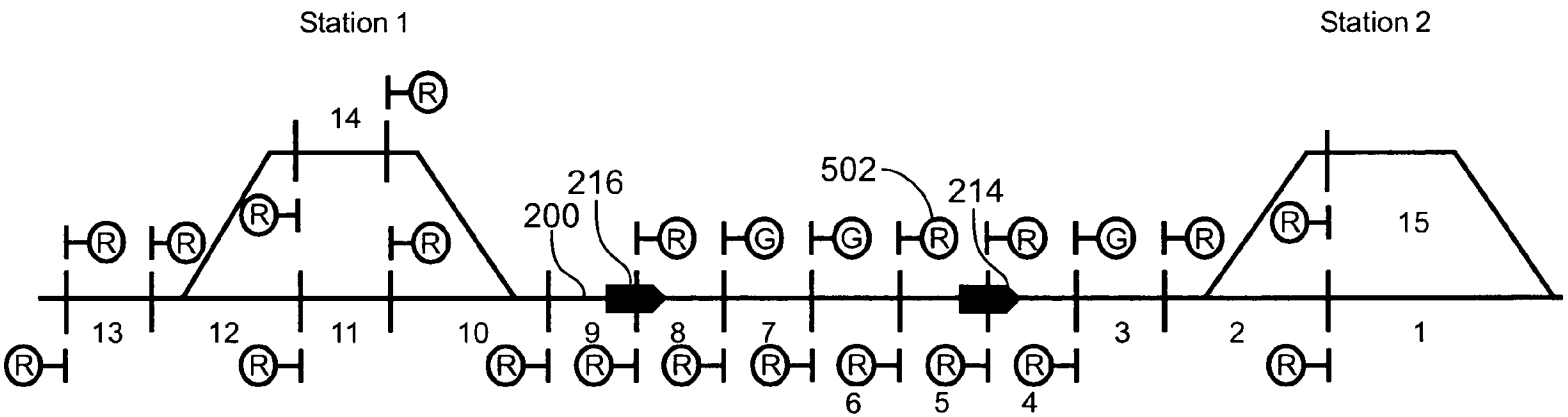
FIG. 5 is a layout diagram of the guideway shown in FIG. 2 with first and second vehicles advancing still further along the guideway.

FIG. 5 is a layout diagram of guideway 200 (shown in FIG. 2) with vehicles 214 and 216 further advancing along guideway 200. Vehicle 214 continues to move forward on the route to station 2 and is illustrated occupying Block numbers 5 and 4. Vehicle 216 advances toward station 2 following vehicle 214 occupying Block number 8. A red block signal 502 at Block number 5 is the most restrictive signal for vehicle 216 while following vehicle 214.

Figure 6:
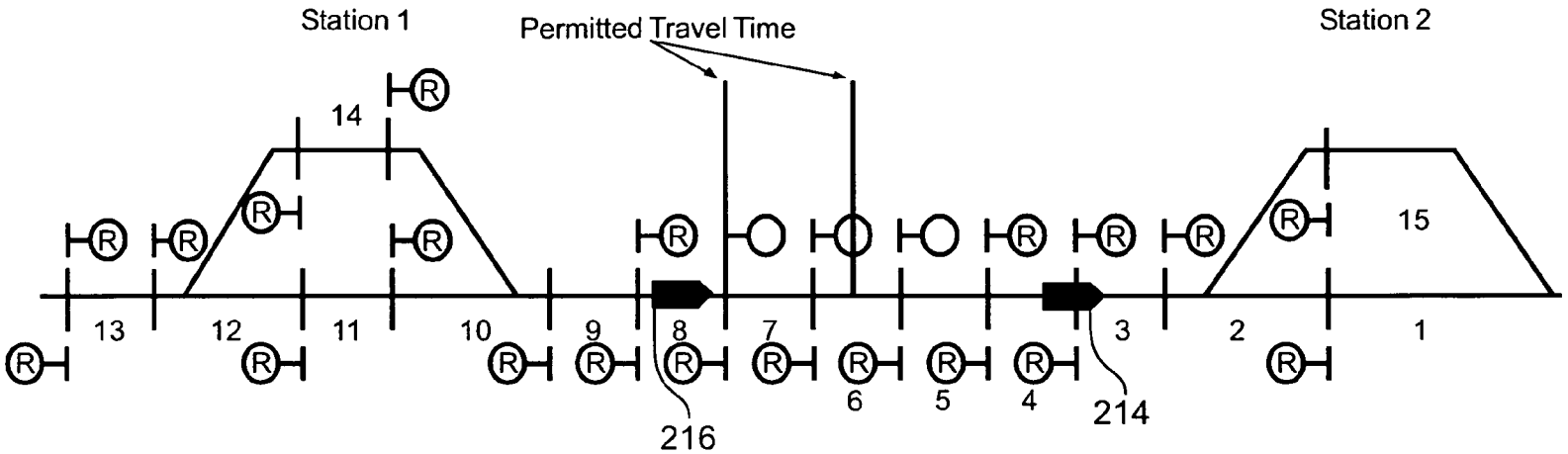
FIG. 6 is a layout diagram of the guideway shown in FIG. 2 with first and second vehicles advancing still further along the guideway.

FIG. 6 is a layout diagram of guideway 200 (shown in FIG. 2) with vehicles 214 and 216 further advancing along guideway 200. If, for example, vehicle 216 experiences a loss of communication to the wayside, in prior art systems, signals for Blocks 7, 6, and 5 are put to "Stop" based on the fixed timeout for all signals. In accordance with embodiments of the present invention however, the communication timeout value is variable based on vehicle 216 location along guideway 200 determined by for example, the blocks being occupied or a position system. The communication timeout may be selectable discrete time values or may be dynamically determined values that are not discrete. Using the variable communication timeout vehicle 216 is permitted to travel an additional distance or amount of time before assuming the signals are at stop. Such additional time would allow more opportunity to receive an authority message, which if received may reset the timeout timer and the block signals to green.

Figure 7:
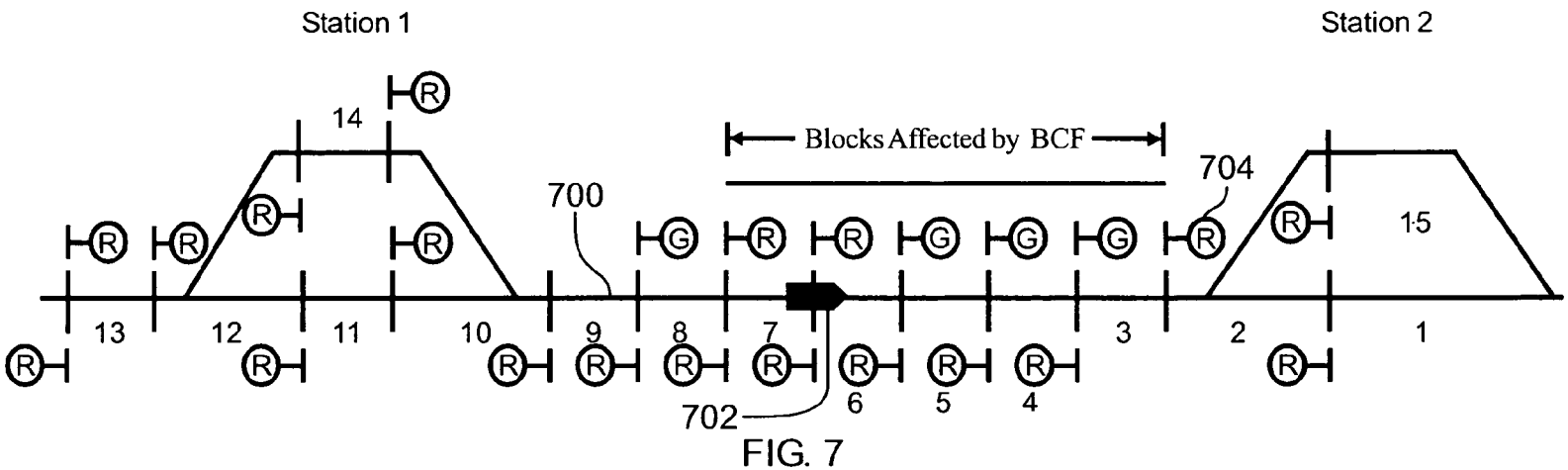
FIG. 7 is a layout diagram of a guideway with a vehicle advancing along the guideway.

FIG. 7 is a layout diagram of a guideway 700 with a vehicle 702 advancing along guideway 700. In the exemplary embodiment, the onboard and wayside communication timeouts are independent and the variable timeout of the respective wayside is based on the location of a vehicle transiting through the block. Vehicle 702 occupies Blocks 7 and 6 and the respective block signals are set to their most restrictive state (red). When vehicle 702 has an intermediate signal ahead of it such as signals associated with blocks 5, 4, and 3 in FIG. 7, the wayside timeout can be extended to a greater value because it is known that there are no other vehicles in blocks 5, 4, and 3. Otherwise the signals associated with blocks 5, 4, and 3 would be red. If a loss of communication between vehicle 702 and the wayside units, the wayside unit commands a Block Communication Failure (BCF), which as used herein, indicates that the position of vehicle 702 along the route is unknown from its last known position to the next home signal. The blocks in the BCF area are set to the receiving home signal 704. In the example shown in FIG. 7, when vehicle 702 losses communication with the wayside, indicated by the communication timeout timing out, the blocks between Block number 7, the last known location and home signal 704 are changed to red to prevent any other vehicle from entering the area where vehicle 702 may be located.

Figure 8:
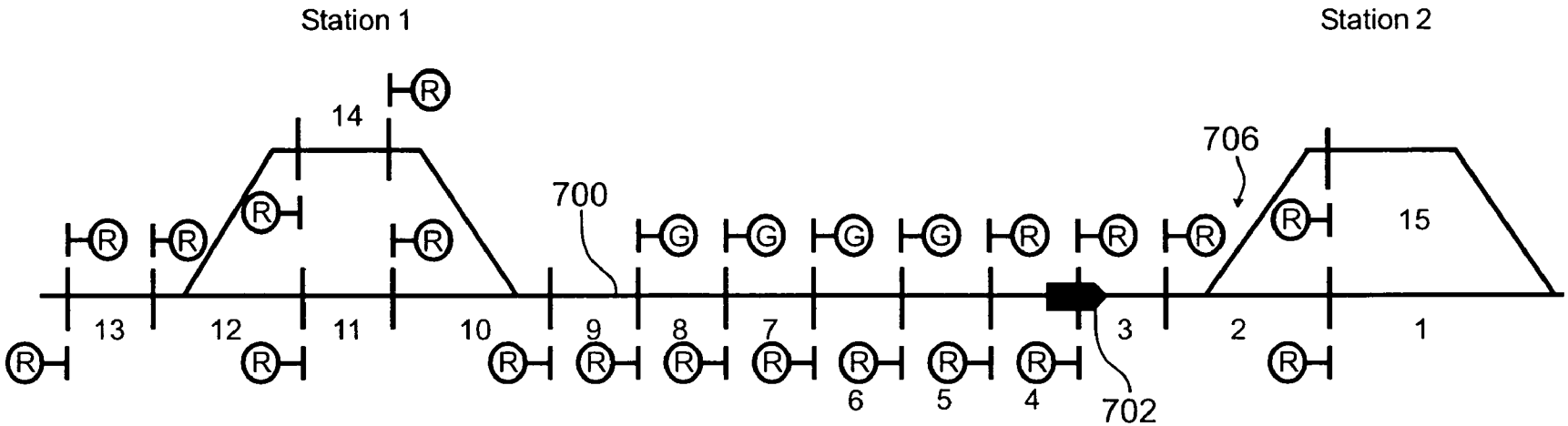
FIG. 8 is a layout diagram of the guideway shown in FIG. 7 with the vehicle advancing along the guideway.

FIG. 8 is a layout diagram of guideway 700 (shown in FIG. 7) with vehicle 702 advancing along guideway 700. In the exemplary embodiment, as vehicle 702 approaches Approach Block 706, the wayside units enforce a shorter communication timeout value. Approach Block 706 length is sized to accommodate a worst case stopping distance plus a worst case timeout based on the shorter communication timeout value.

While embodiments of the disclosure have been described in terms of various specific embodiments, those skilled in the art will recognize that the embodiments of the disclosure can be practiced with modification within the spirit and scope of the claims.

What is claimed is:

1. A method of communicating with a vehicle, said method comprising:

providing a plurality of wayside control units configured to control an area along a guideway to be traveled by the vehicle, the plurality of wayside control units including a database of fixed data defining an operational profile of the guideway in a local area of an associated wayside control unit;

monitoring dynamic data in the local area of the associated wayside control unit, the dynamic data including at least one of guideway availability and signal status information;

transmitting wirelessly an authority message including at least one of the fixed data and the dynamic data from the associated wayside unit to a receiver on board the vehicle, the authority message dynamic data being valid for a time period selected from among a plurality of time periods; and selecting the time period based on a location of the vehicle while the vehicle is changing location along the guideway.

2. A method in accordance with claim 1 wherein the authority message dynamic data is valid for a discrete time period selectable from a plurality of discrete time periods.

3. A method in accordance with claim 1 wherein the authority message dynamic data is valid for a time period determined using at least one of the fixed data, the dynamic data, the speed of the vehicle, the location of the vehicle, and the braking characteristics of the vehicle.

4. A method in accordance with claim 1 further comprising dynamically determining the time period.

5. A method in accordance with claim 1 further comprising dynamically determining the time period using a computer on board the vehicle.

6. A method in accordance with claim 1 further comprising determining one or more proper vehicle control instructions from the received fixed and dynamic data.

7. A method in accordance with claim 1 further comprising storing the plurality of time periods in a database associated with at least one of a wayside control unit, an onboard computer, and a central computer configured to coordinate and oversee the operation of a plurality of wayside control units.

8. A method in accordance with claim 1 further comprising:

transmitting a vehicle location message from the vehicle to a wayside control unit;

if the wayside control does not receive the vehicle location message within in a determined time period, initiating a communication failure action for signals, the determined time period based on the vehicle last reported position.

9. A system for controlling the movement of a train along a railroad track, the system comprising:

a data base configured to store fixed data defining an operational profile of one or more local areas associated with the track;

a plurality of wayside control units configured to control an area along the track, each wayside control unit configured to monitor track availability and signal status information in a corresponding local area of the wayside control unit;

a communication link configured to transmit the fixed data for the area and dynamic data including track availability and signal status information to a train within the associated local area wherein the dynamic data is valid for at least one of a selected time period selectable from a plurality of time periods and a determined period of time; and wherein, the system is configured to set the at least one of the selected time period and the determine the determined time period, based on a location of the vehicle while the vehicle is changing location along the railroad track.

10. A system in accordance with claim 9 further comprising an onboard computer configured to receive transmissions of fixed and dynamic data from the wayside control unit.

11. A system in accordance with claim 9 wherein the database is further configured to store a plurality of time periods associated with at least one of a wayside control unit, an onboard computer, and a central computer configured to coordinate and oversee the operation of a plurality of wayside control units.

12. A system in accordance with claim 9 further comprising an on board computer configured to determine the location of the train along the route.

13. A system in accordance with claim 9 wherein each of said wayside units includes a device for transmitting a message including the fixed data and an authority message containing the dynamic data, said onboard computer including a radio configure to transmit requests to the controlling wayside unit for transmission of profile and authority messages.

14. A system in accordance with claim 9 wherein the vehicle is configured to transmit a vehicle location message from the vehicle to a wayside control unit and wherein if the wayside control does not receive the vehicle location message within in a determined time period, the wayside control unit is configured to initiate a communication failure action, the determined time period based on the vehicle last reported position.

15. A method of controlling the movement of a train along a block of railroad track, said method comprising:

transmitting wirelessly an authority message including at least one of fixed data and dynamic data from a wayside unit associated with the block of railroad track to a receiver on board the train, the authority message dynamic data being valid for a period of time determined using at least one of the fixed data, the dynamic data, the braking characteristics of the train, a speed of the train, a location of the train, and a proximity of the train to a home signal; and determining the period of time based on a location of the train while the train is changing location along the railroad track.

16. A method in accordance with claim 15 wherein transmitting an authority message from a wayside unit associated with the block of railroad track further includes interrogating the wayside unit within the period of time to request the transmission of an updated authority message, and applying a default rule if no updated message is received by the train.

17. A method in accordance with claim 15 further comprising receiving dynamic data in the local area of the associated wayside control unit, the dynamic data including at least one of guideway availability and signal status information.

18. A method in accordance with claim 15 wherein the time period is dynamically determined.

19. A method in accordance with claim 15 wherein the authority message dynamic data is valid for a discrete time period selectable from a plurality of discrete time periods.

20. A method in accordance with claim 15 wherein the authority message dynamic data is valid for a time period determined using at least one of the fixed data, the dynamic data, the speed of the vehicle, the location of the vehicle, and the braking characteristics of the vehicle.

21. A method in accordance with claim 15 further comprising dynamically determining the time period by at least one of an onboard computer, a wayside control unit computer, and a central station computer.

22. A method in accordance with claim 15 further comprising providing a central control facility in which fixed data is stored that defines an operational profile of a route to be traveled by a train.

* * * * *